United States Patent [19]

Wagemer

[11] 3,936,783

[45] Feb. 3, 1976

[54] MEDIUM FREQUENCY POWER TRANSFORMER WITH A SECONDARY WINDING SUITABLE FOR A RIGID CONNECTION WITH AN INDUCTOR THROUGH WHICH THE COOLANT FLOWS

[75] Inventor: Wilfried Wagemer, Wuppertal, Germany

[73] Assignee: AEG-Elotherm G.m.b.H., Remscheid-Hasten, Germany

[22] Filed: June 3, 1974

[21] Appl. No.: 475,959

[30] Foreign Application Priority Data

June 1, 1973 Germany ..... 2328024

[52] U.S. Cl. ..... 336/62; 336/183; 336/212; 336/232

[51] Int. Cl.[2] ..... H01F 27/08

[58] Field of Search ..... 336/55, 62, 212, 232, 192, 336/225, 180, 183; 310/61, 60 A, 54

[56] References Cited

UNITED STATES PATENTS

| | | | |
|---|---|---|---|
| 3,503,026 | 3/1970 | Geisel et al. | 336/62 |
| 3,728,655 | 4/1973 | Reinke | 336/62 |

FOREIGN PATENTS OR APPLICATIONS

| | | | |
|---|---|---|---|
| 479,394 | 2/1938 | United Kingdom | 336/62 |
| 1,077,845 | 11/1954 | France | 336/62 |

*Primary Examiner*—Thomas J. Kozma
*Attorney, Agent, or Firm*—Cushman, Darby & Cushman

[57] ABSTRACT

An improved medium power transformer of the type having a secondary winding suitable for rigid connection with an inductor through which coolant flows, the secondary winding conductors overlapping in the area of the secondary connections and having two layers of primary windings flanking the secondary winding, core elements enclosing the hollow winding conductors except in the area of overlap. To minimize the thickness of the transformer, a cooling line having two separated portions is disposed in overlap along the periphery of the secondary winding in one layer.

4 Claims, 3 Drawing Figures

MEDIUM FREQUENCY POWER TRANSFORMER WITH A SECONDARY WINDING SUITABLE FOR A RIGID CONNECTION WITH AN INDUCTOR THROUGH WHICH THE COOLANT FLOWS

The invention relates to a medium frequency power transformer with a one-winding, flat secondary winding, suitable for rigid connection with an inductor through which a coolant flows, the winding conductors of which overlap in the area of the secondary connections and with two layers of primary windings disposed at both sides of the secondary winding, which are formed by hollow conductors and line up in a packet, are provided with framelike core bodies consisting especially of ferrite and enclosing the winding conductors, whereby the overall dimension of the transformer in the direction perpendicular to the front surfaces of the secondary winding or to the layers of primary winding is small as compared to its overall dimensions in the direction parallel to these front surfaces.

Such medium frequency power transformers are known for example from U.S. Pat. No. 3,728,655 and are used advantageously for inductive hardening of bearing places of crankshafts, as described for example in the German Pat. No. 1,209,137. For this known hardening process, unilaterally open, so-called half-shell inductors are used which constitute a solid construction unit together with the transformer feeding them and which follow the movement of the bearing with the assigned transformer, during the inductive heating with a rotating crankshaft and sitting on the bearing that is to be tempered. If several crankshaft bearings are to be tempered simultaneously, then the pertinent transformer-inductor units must not disturb each other during their movements. This can be achieved in the most simple way by ensuring that the overall dimension of the medium frequency transformers used is smaller in the direction parallel to the axis of the crankshaft than the medium distance between two adjacent bearings that are to be hardened simultaneously.

In the case of the medium frequency power transformer known from above mentioned U.S. patent, the front surfaces of the layers of secondary windings occupy two parallel-strip-shaped areas, which are supplemented at their ends by arch-shaped areas for the front surface of the winding or the layers. The framelike core bodies at the same time are stacked up only along the parallel, strip-like areas of the front surfaces of the winding or the layers so that for the attachment of the stack of magnetic cores, two clamping elements with contact pressure against the ends of said stacks are employed. In one of these clamping elements, secondary connections of the transformers are brought out. In the case of this known transformer, the secondary winding advantageously consists of several hollow profiled conductors connected electrically in parallel and arranged in one layer, the hollow spaces of which are at least in part serially connected in relation to the coolant flow.

In order to make possible the feed of the coolant connections of the inductor within the clamping piece on the secondary connection side, the secondary winding can be made such that its overall power in the area of the transformer secondary connections to the inductor in which the winding conductors overlap, does at least not substantially exceed its overall power in its remaining areas. As a result of that, the winding packet in the area of the secondary connections remains sufficiently narrow so that the coolant connecting leads for the inductor can still be accommodated inside the maximum thickness of the transformer conditional on the corresponding dimension of the frameshaped core elements, in the clamping piece on the secondary connection side. Medium frequency power transformers of this construction had already been realized down to a 50 mm thickness.

In order to temper adjacent bearings of a crankshaft simultaneously, or to leave them with a rotating shaft simultaneously in engagement with the assigned transformer-inductor units, this small thickness of the plate-shaped transformers achieved hitherto is still too great in many cases.

The invention, therefore, is based on the object of producing a medium frequency power transformer of the mentioned type in the case of which no core elements are provided in the area of the transformer secondary connections to the inductor in which the winding conductors of the secondary windings overlap, and in the case in which, with at least equally high performance and coolant connections for the inductor within the frame of the transformer, a still lower maximum transformer thickness can be achieved than in the case of the transformers according to the German application Ser. No. 2,133,987 laid open to public inspection.

This object is solved by the medium frequency power transformer according to this invention, in which, along the periphery of the secondary winding, a coolant line is provided arranged in one layer with the secondary winding conductors, which line has a first separation acting at least in relation to the coolant flow, at which the ends of separation are connected with coolant connections disposed in the transformer frame, and a second separation in the area of the transformer secondary connections, the ends of the separation of which are connected with the coolant connections of the inductor. At the same time, the coolant line preferably consists of an electric, hollow profile conductor which is connected electrically conductively with the remaining winding conductors of the secondary winding.

According to a preferred embodiment of the invention, the coolant supply line or the coolant discharger line for the cooling of the secondary winding are disposed between the coolant line connections of the ends of the first separation with the coolant connections in the frame of the transformer.

According to a further preferred embodiment of the invention, the overall thickness of the secondary winding in the area of its connections, in which the winding conductors overlap, is considerably greater than in its remaining areas, whereby the layers of primary windings have an underslung form or one bent toward the outside in the direction of the transformer thickness measurement in the above-mentioned connecting area of the secondary winding corresponding to the increase in thickness of the secondary winding.

The invention will be explained in detail subsequently on the basis of the Figures in which.

Figure 2:
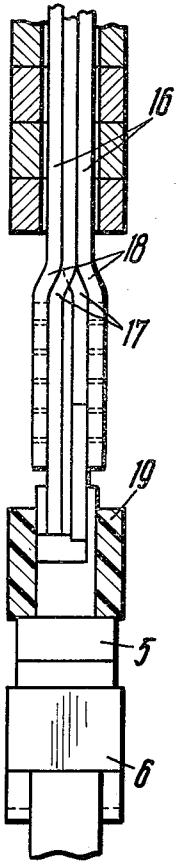
FIG. 2 shows a cut away view along the line I—I in FIG. 1.
Figure 1:
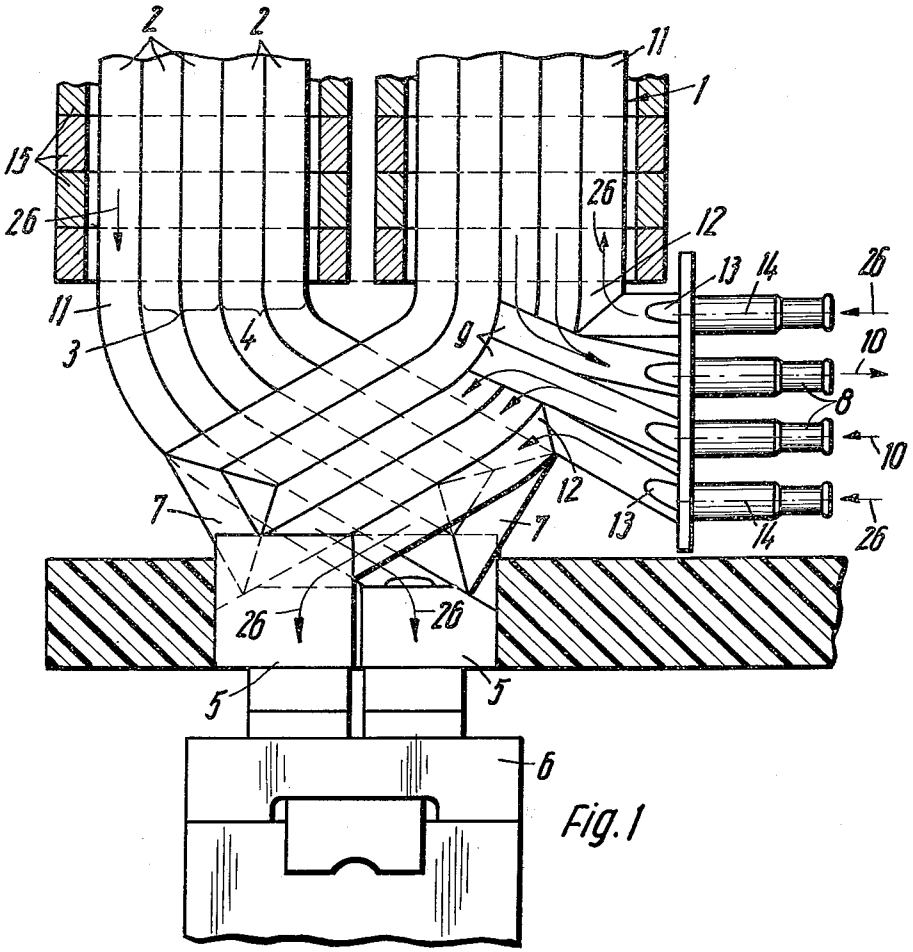
FIG. 1 shows schematically the end of the secondary winding on the connecting side and the arrangement of its connections to the inductor in the case of a transformer of the type described in German application Ser. No. 2,133,987 open to public inspection.

Referring to FIGS. 1 and 2, as in the case of the above mentioned U.S. patent, the one layer and secondary winding 1 of the transformer is built up from copper pipes 2 with a rectangular cross-section. It contains at the same time two tracks 3, 4 disposed in the same layer and at two copper pipes each, which are provided at the overlapping ends of the secondary winding 1 with the electrical and coolant connections 5 for the inductor indicated by 6, and which at the ends of the above-mentioned secondary windings each time pass over into one another by way of a connecting piece 7.

For feeding in of the coolant for the cooling of secondary winding 1, two hollow elements 9 made of copper and provided with coolant connections 8 are switched in, in the winding track 3, by which the coolant is fed in or discharged in the sense of the arrows 10. As explained further in the above mentioned U.S. patent two tracks 3, 4 are therefore connected electrically in parallel, but are serially connected as far as the coolant is concerned.

Along the periphery of the track 3 of the copper pipe and in the same layer as the tracks 3 and 4, an additional copper pipe has been arranged which, electrically forming a part of the secondary winding, serves as a coolant line 11 for the inductor. Coolant line 11 has a first separation 12 between the ends of which the hollow copper elements 9 lie, which have been mentioned and serve as a coolant supply or a coolant delivery line for the secondary winding. These separated ends are connected with the coolant connections 14 by way of hollow copper pieces 13.

Figure 3:
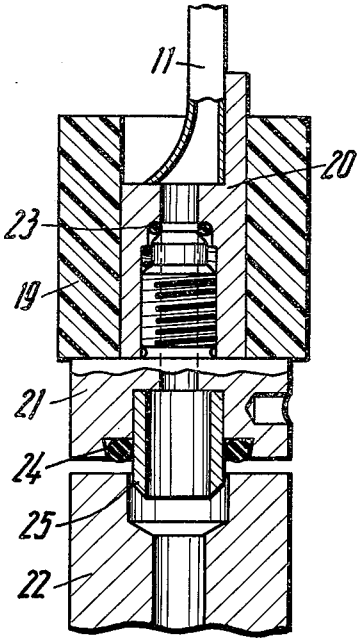
FIG. 3 shows the connection to the inductor in detail.

The ends of a second separation of the coolant line 11, which in the area of the transformer secondary connections 5 correspond to the ends of the copper pipe track 3, on their parts, as described in more detail further below in conjunction with FIG. 3, are connected with the coolant connections of the inductor 6. The copper pipes of the tracks 3 and 4, the coolant line 11, the connecting pieces 7, as well as the hollow copper elements 9 and 13, are all connected with one another by hard soldering in order to form the secondary winding. The finished secondary winding is coated with an electrically insulating eddy-current sintered layer.

In FIGS. 1 and 2, a few framelike core bodies 15, disposed in two stacks, enclose the strip-shaped areas of the winding packet formed from the secondary winding 1 and the two layers 16 of primary windings. The secondary winding 1 in its area on the secondary connection side and free of the core bodies 15 has two shoulders 17 near the beginning of the stack of core bodies (see FIG. 2), which permit the conductors of the secondary winding to be developed, even in their overlapping area, to approximately the same thickness as in the remaining areas of the secondary winding. In the above-mentioned overlapping area, the layers 16 of the primary winding each time have a shoulder 18 following the course of the bend of the secondary winding 1. The connections 5 of the secondary winding 1 are attached in a strip 19 made of electrically insulating material, which constitute a part of the transformer frame which, for reasons of an improved clarity, have not been otherwise shown in the figures.

In FIG. 3, the connection 5 to the inductor 6 is shown in detail in section. The ends of the coolant line 11 are soldered together with a connecting piece 20 made of square copper, which is embedded in a corresponding recess of the strip 18. The axial channel of the connecting piece 20 at the same time has an internal thread, in which a contact element 21 provided with an axial bore is screwed in, the free front surface of which serves as a contact surface for the electric contacting of the inductor contact element 22. In continuation of its axial bore, contact element 12 has an extension 25 projecting beyong its contact surface, which is guided in the corresponding axial bore of inductor element 22. Two O-rings 23 and 24 securely seal the coolant between the contact element 21 on the one hand and the connection element 20 or the inductor-contact element 22 on the other hand.

In the case of the previously described arrangement, the inductor 6 can advantageously have two cooling circuits. In that case, both sections of the coolant line 11, as indicated by arrows 26, serve for the coolant supply. The discharge of the coolant from the inductor is then not guided by way of the connections in the transformer frame. If on the other hand, there is only one coolant circuit in the inductor, one of the coolant sections can also serve advantageously for the coolant supply and the other for the coolant discharge.

Many changes and modifications in the above-described embodiment of the invention can, of course, be carried out without departing from the scope thereof. Accordingly, that scope is intended to be limited only by the scope of the appended claims.

What is claimed is:

1. In a medium frequency power transformer with a frame, two layers of primary windings, a secondary winding comprising a plurality of secondary conductors which overlap in the area of rigid secondary coolant connections to an inductor through which coolant flows, said two layers of primary windings being arranged at both sides of the secondary winding and formed by hollow conductors and lined up to a packet, and a plurality of ferrite, framelike core bodies enclosing the primary and secondary windings, whereby in the area of the transformer secondary connections, in which the secondary conductors of the secondary winding overlap, no core elements are provided and whereby the overall dimensions of the transformer are small in the direction perpendicularly to the front surfaces of the secondary winding and of the layers of the primary winding as compared to its overall dimensions parallel to these front surfaces, the improvement compising:

a coolant line arranged with the secondary winding conductors in one layer and disposed along the periphery of the secondary winding, said coolant line having a first separation to which the separation ends are connected by means of coolant connections arranged in the transformer frame, and a second separation in the area of the transformer secondary connections, the ends of the second separation of which are connected with the coolant connections of the inductor.

2. In a medium frequency power transformer as in claim 1, the further improvement wherein the coolant line comprises an electric hollow profile conductor connected electrically conductively with the secondary conductors of the secondary winding.

3. In a medium frequency power transformer as in claim 1, a further improvement wherein a second coolant line for the cooling of the secondary winding, is arranged between the coolant line connections of the ends of the first separation with the coolant connections in the transformer frame.

4. In a medium frequency power transformer as in claim 1, the further improvement wherein the overall thickness of the secondary winding in the area of its connections, in which the winding conductors overlap, is essentially greater than in its remaining areas, whereby the layers of the primary winding have a form underslung or bent to the outside in the direction of the transformer-thickness measurement in the above mentioned area of secondary connection and corresponding to the increase of the thickness of the secondary winding.

* * * * *